US005161476A

United States Patent [19]

Suzuki

[11] Patent Number: 5,161,476

[45] Date of Patent: Nov. 10, 1992

[54] PATTERN MATCHING SYSTEM

[75] Inventor: Shigeru Suzuki, Nagoya, Japan

[73] Assignee: Brother Kogyo Kabushiki Kaisha, Nagoya, Japan

[21] Appl. No.: 742,427

[22] Filed: Aug. 8, 1991

[30] Foreign Application Priority Data

Aug. 9, 1990 [JP] Japan ..... 2-212490

[51] Int. Cl.[5] ..... D05B 27/06; D05B 27/08

[52] U.S. Cl. ..... 112/306; 112/314; 112/320; 112/121.11; 226/32; 356/419

[58] Field of Search ..... 112/314, 313, 306, 320, 112/121.11; 356/416, 419, 425, 402; 226/32; 250/226, 548

[56] References Cited

U.S. PATENT DOCUMENTS

| | | | |
|---|---|---|---|
| 3,726,399 | 4/1973 | Beamish | 112/121.11 X |
| 3,954,071 | 5/1976 | Mall et al. | 112/314 X |
| 4,612,867 | 9/1986 | Rosch et al. | 112/314 |
| 4,658,741 | 4/1987 | Jehle et al. | 112/314 X |
| 4,757,773 | 7/1988 | Nomura et al. | 112/121.11 |
| 4,766,828 | 8/1988 | Nomura et al. | 112/314 |
| 4,777,896 | 10/1988 | Nomura | 112/314 |
| 4,867,087 | 9/1989 | Suzuki et al. | 112/314 |
| 4,898,110 | 2/1990 | Nomura et al. | 112/314 |
| 4,901,659 | 2/1990 | Nomura et al. | 112/314 |
| 4,901,660 | 2/1990 | Takeuchi et al. | 112/314 |
| 4,917,031 | 4/1990 | Itoh | 112/121.11 |
| 4,982,677 | 1/1991 | Nomura et al. | 112/314 |
| 5,001,998 | 3/1991 | Suzuki et al. | 112/314 |
| 5,012,752 | 5/1991 | Murata et al. | 112/121.12 |

*Primary Examiner*—Peter Nerbun
*Attorney, Agent, or Firm*—Oliff & Berridge

[57] ABSTRACT

A sewing machine has a pattern matching system for matching patterns on two fabric pieces to be sewn to each other, based on detected hues of the patterns. Any mismatch between the patterns is calculated on the basis of color quality information converted from detected intensities of light which is reflected by the fabric pieces. The fabric pieces are fed relatively to each other so that the patterns thereon are matched, based on the calculated mismatch.

27 Claims, 8 Drawing Sheets

PATTERN MATCHING SYSTEM

BACKGROUND OF THE INVENTION

The present invention relates to a pattern matching system, and more particularly to a sewing machine with a pattern matching system for matching the patterns on two fabric pieces while the fabric pieces are being sewn to each other.

One conventional sewing machine with a pattern matching capability is disclosed in Japanese Laid-Open Patent Publication No. Sho60-153896. The disclosed sewing machine has optical sensors for detecting two respective fabric pieces, the optical sensors being located in front of a position where the fabric pieces are to be sewn to each other in overlapping relationship. The optical sensors detect light rays reflected from the fabric pieces. The intensities of the reflected light rays vary depending on patterns on the fabric pieces. Therefore, when the reflected light rays are detected by the optical sensors in synchronism with the feeding of the fabric pieces, the optical sensors detect patterns of light intensity variations corresponding to the fabric patterns. The detected patterns of light intensity variations are compared with each other, and any deviation or misalignment between the fabric pieces is calculated from the difference or shift between the compared patterns. The rate at which the two fabric pieces are fed relatively to each other is then adjusted in order to eliminate the mismatch between the fabric patterns, for thereby automatically matching the fabric patterns.

Japanese Laid-Open Patent Publication No. Heil-192387 discloses a pattern matching system which has R, G and B color sensors for detecting color differences between the colors of patterns. Based on the detected color differences, it is determined how color saturations are changed on the patterns of fabrics, to thereby calculate any mismatch between the patterns.

The conventional pattern matching systems thus utilize optical information of the patterns on fabric pieces that represents only lightness which indicates the brightness of colors and saturation which indicates the depth of colors. The prior pattern matching systems do not detect hue which indicates the types of colors, i.e., the kind by which one color is distinguished from another color. Therefore, the conventional pattern matching systems have been unable to detect any mismatch between patterns which have the same lightness and saturation, but are of different hues.

SUMMARY OF THE INVENTION

In view of the aforesaid problems of the conventional pattern matching systems, it is an object of the present invention to provide a pattern matching system which can also determine the types of colors on patterns so that any misalignment can be detected accurately between the patterns which have the same lightness and saturation, but are of different hues.

According to the present invention, there is provided a pattern matching system for positioning with respect to one another a plurality of pattern-holding members having identical patterns thereon in such a manner that the patterns on the pattern-holding members are matched with one another, the pattern matching system comprising: color quality detecting means for receiving light from the patterns on the pattern-holding members to thereby obtain informations indicative of qualities of colors of the patterns including at least types or hues of the colors; pattern mismatch calculating means for calculating a mismatch amount between the patterns on the pattern-holding members, based on the informations indicative of the qualities of colors of the patterns; and feeding means for feeding the pattern-holding members relative to each other, based on the mismatch amount calculated by the pattern mismatch calculating means, to thereby position the pattern-holding members with the patterns being matched.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIGS. 10(*b*) through 10(*e*) are diagrams of data indicating color qualities of the upper and lower fabric pieces; and FIGS. 10(*f*) through 10(*m*) are diagrams showing the manner in which the color quality data and a pattern misalignment or mismatch are calculated.

DETAILED DESCRIPTION OF THE PREFERRED EMBODIMENT

A preferred embodiment of the present invention will be described in greater detail hereinafter with reference to the accompanying drawings.

Figure 1:
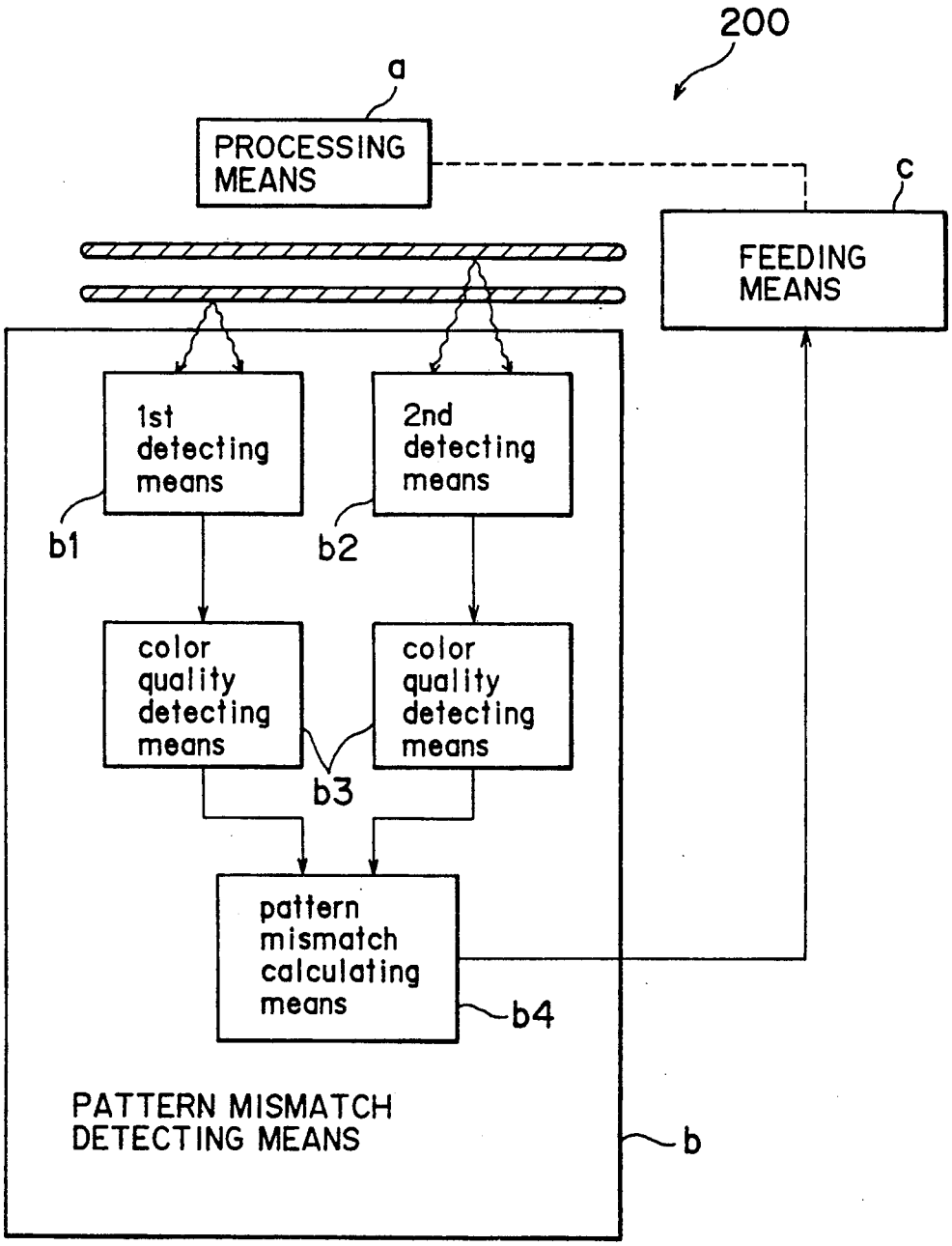
FIG. 1 is a block diagram showing the concept of a pattern matching system according to the embodiment of the present invention.

As shown in FIG. 1, a pattern matching system 200 of the embodiment of the present invention mainly includes: processing means a for joining two sheet-like members with identical patterns thereon, in overlapping relation; pattern mismatch detecting means b for detecting a mismatch between the patterns on the sheet-like members; and feeding means c for feeding the sheet-like members to the processing means so that the patterns on the sheet-like members may be matched, based on the detected mismatch; the pattern mismatch detecting means b including first detecting means b1 for detecting intensities of light of different hues in response to light from one of the sheet-like members, second detecting means b2 for detecting intensities of light of different hues in response to light from the other of the sheet-like members, color quality detecting means b3 for converting the intensities of light detected by the first and second detecting means into information indicative of a quality of color including at least a color type or color hue, and pattern mismatch calculating means b4 for calculating the mismatch between the patterns based on the information indicative of the quality of color.

Any mismatch between the patterns on the sheetlike members in overlapping relationship is detected by the pattern mismatch detecting means b, and the sheet-like members are fed by the feeding means c so that the patterns on the sheet-like members are matched, based on the detected pattern mismatch. The sheet-like members thus fed with the patterns being matched are joined to each other by the processing means a. The intensities of light of different hues detected by both the detecting means b1 and b2 are converted by the color quality detecting means b3 into information indicative of the quality of color including color hue. The pattern mismatch is calculated by the pattern mismatch calculating means b4 based on the information indicative of the quality of color.

Figure 2:
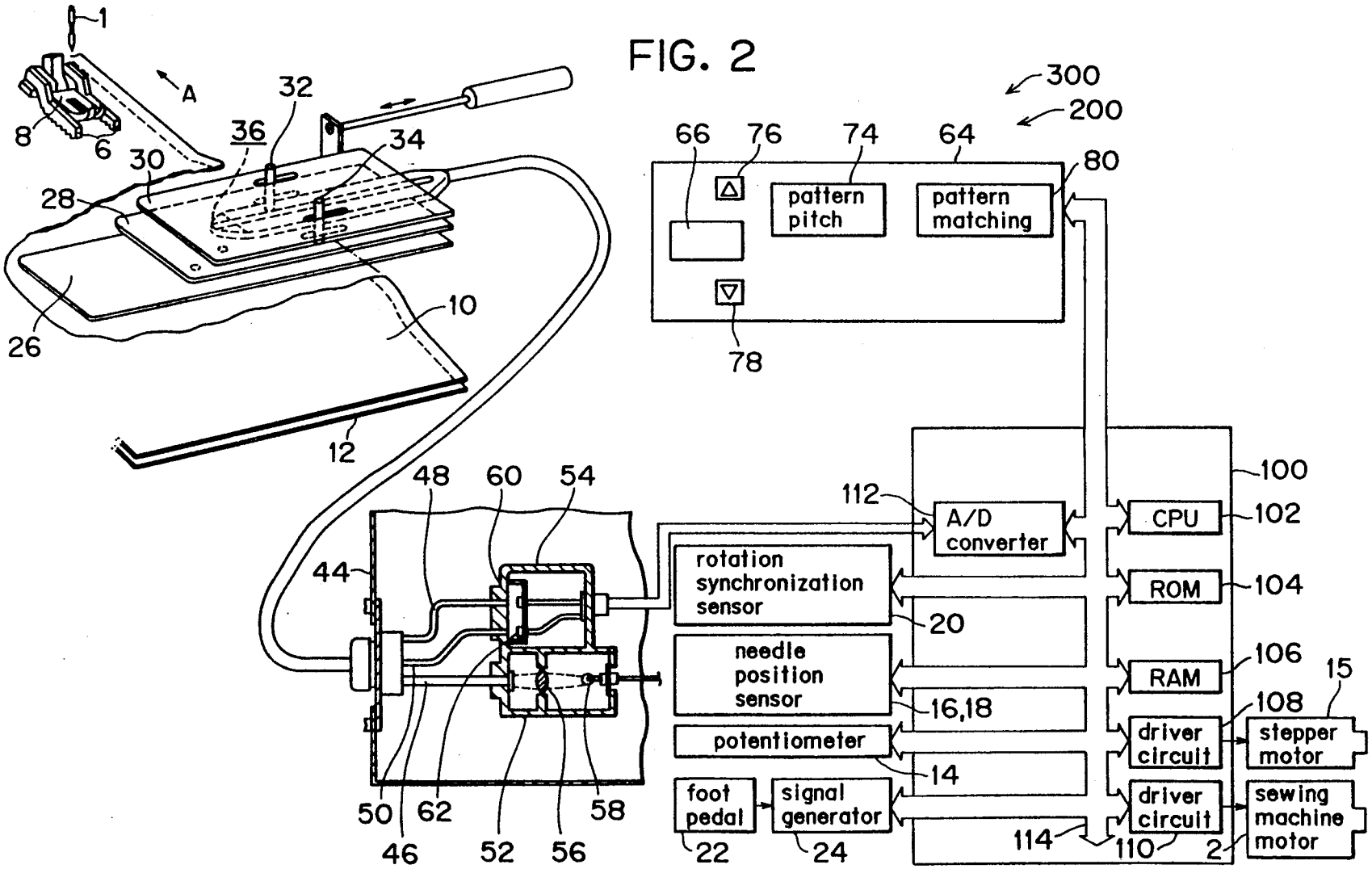
FIG. 2 is a fragmentary perspective view, partly in sectional and block form, of a sewing machine incorporating the pattern matching system according to the invention.

FIG. 2 shows a sewing machine 300 which incorporates the pattern matching system 200 according to the invention.

Figure 3:
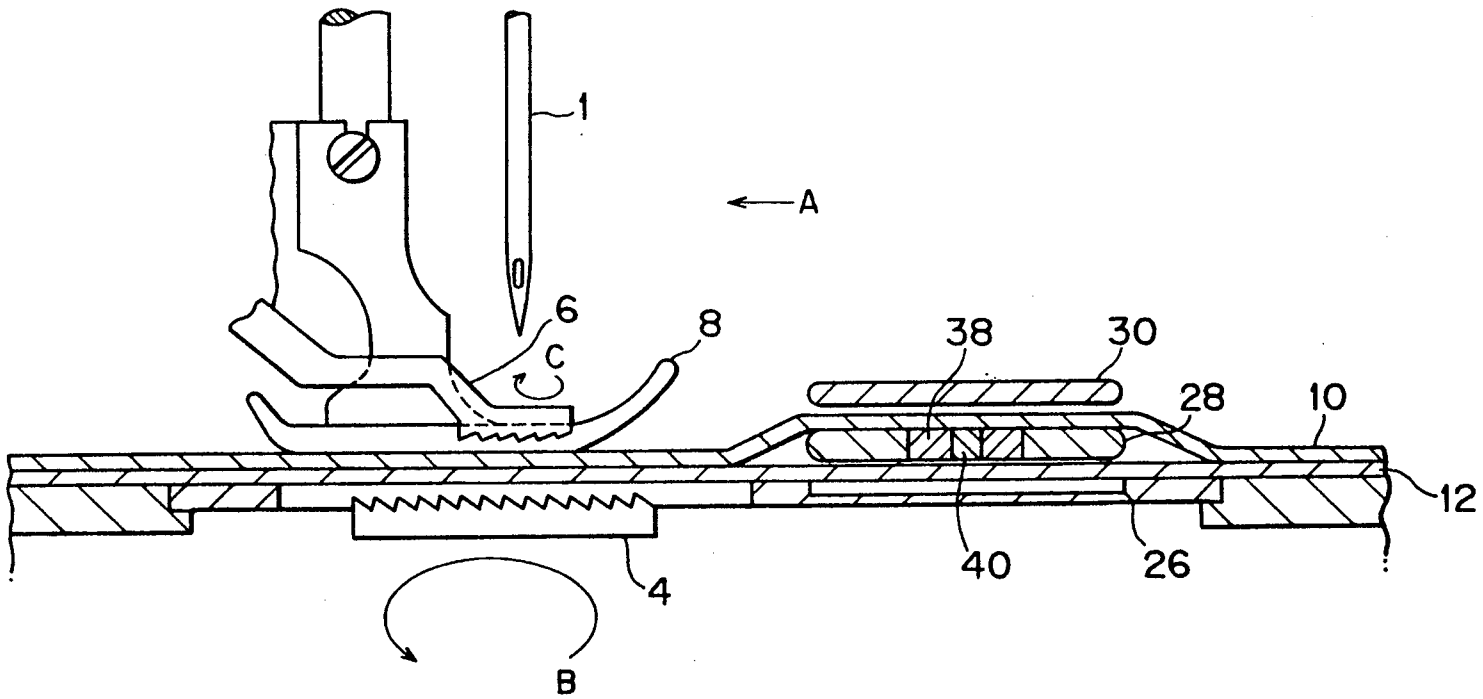
FIG. 3 is a fragmentary cross-sectional view of a sewing mechanism of the sewing machine.

The sewing machine 300 includes a sewing needle 1 which is vertically movable reciprocally by a motor 2. The sewing machine also has a lower feed dog 4 movable vertically and horizontally in a pattern indicated by an arrow B in FIG. 3, and an upper feed dog 6 movable vertically and horizontally in a pattern indicated by an arrow C. The lower feed dog 4 and the upper feed dog 6 are also driven by the motor 2. Two overlapping fabric pieces 10 and 12 which are to be sewn by the sewing needle 1 are pressed down by a presser foot 8. The fabric pieces 10 and 12 are sewn to each other by the sewing needle 1 which moves vertically in synchronism with the movement of the lower and upper feed dogs 4 and 6 to feed the fabric pieces 10 and 12 in the direction indicated by an arrow A.

The distance by which the lower feed dog 4 feeds the lower fabric piece 12 in the direction indicated by the arrow A in one cycle can be adjusted by an adjusting mechanism (not shown). The distance by which the lower fabric piece 12 is fed by the lower feed dog 4 is detected by a potentiometer 14. The distance by which the upper feed dog 6 feeds the upper fabric piece 10 in the direction indicated by the arrow A in one cycle can be adjusted by a stepper motor 15. Therefore, the distance by which the lower fabric piece 12 is fed by the lower feed dog 4 is varied to adjust a sewing pitch. The distance by which the upper fabric piece 10 is fed by the upper feed dog 6 is varied by the stepper motor 15, for thereby varying the rate at which the upper fabric piece 10 is fed with respect to the rate at which the lower fabric piece 12 is fed. In this manner, the rates at which the upper and lower fabric pieces 10 and 12 are fed can be adjusted relatively to each other.

As shown in FIG. 2, signals indicative of upper and lower positions of the sewing needle 1 are produced by respective needle position sensors 16 and 18. A rotation synchronization sensor 20 produces a signal in synchronism with the rotation of the motor 2. A signal generator 24 generates signals in relation to operation of a foot pedal 22. More specifically, the signal generator 24 generates a start signal when a front end of the foot pedal 22 is depressed, a stop signal when the foot pedal 22 is not depressed, and a thread cutting signal for commanding a known thread cutting operation when a rear end of the foot pedal 22 is depressed.

The upper and lower fabric pieces 10 and 12 pass between three fabric guide plates 26, 28 and 30 which are vertically spaced at suitable intervals. The lowermost fabric guide plate 26 has vertical pins 32 and 34 extending through slots defined in the other fabric guide plates 28 and 30. The pins 32 and 34 serve to abut against edges of the upper and lower fabric pieces 10 and 12 to prevent them from being displaced transversely to the feeding direction indicated by the arrow A.

Figure 4:
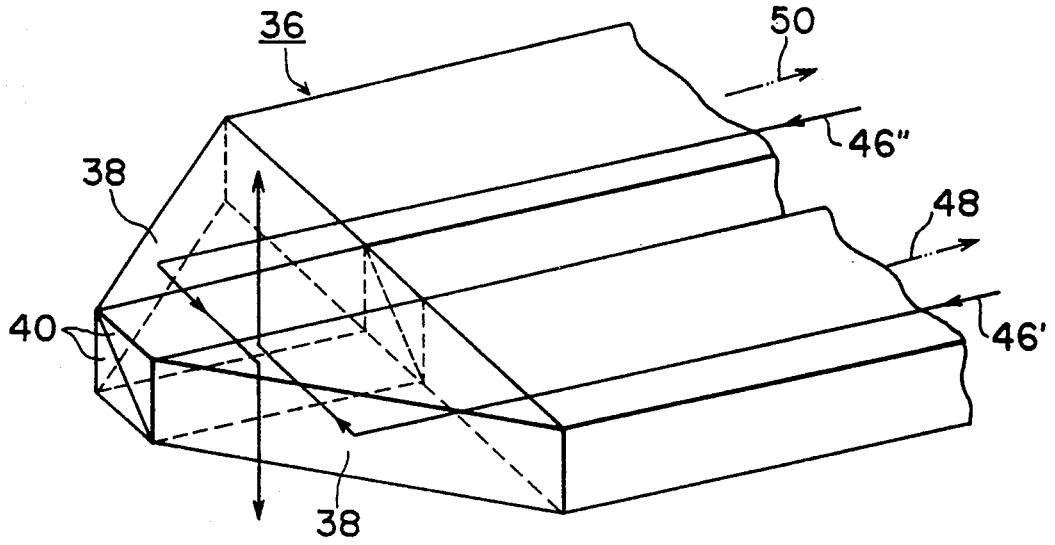
FIG. 4 is a fragmentary perspective view of a distal end of a detector.
Figure 5:
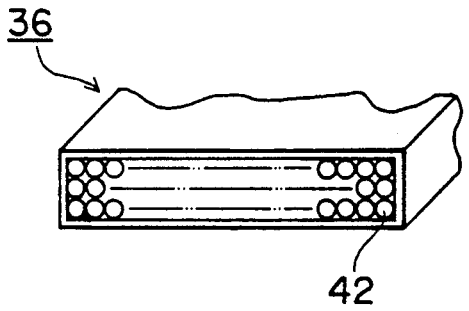
FIG. 5 is a fragmentary perspective view showing an inner structure of the detector.

The middle fabric guide plate 28 incorporates a detector 36 for detecting pattern information of the upper and lower fabric pieces 10 and 12. As shown in FIG. 4, the detector 36 has a plurality of prisms 38 and 40 on its distal end for emitting light rays toward the upper and lower fabric pieces 10 and 12 through reflections and also for receiving light rays reflected by the upper and lower fabric pieces 10 and 12 through reflections. The detector 36 houses a bundle of optical fibers 42 as shown in FIG. 5 which extend from the end of the detector 36, remote from the prisms 38 and 40, and are connected to a control casing 44.

The optical fibers 42 include a set of light-emitting optical fibers 46 coupled to a light-emitting unit 52 and two sets of light-receiving optical fibers 48 and 50 coupled to a light-detecting unit 54. The set of light emitting optical fibers 46 is divided into two groups 46' and 46'' of optical fibers, one group 46' serving to emit light rays to the upper fabric piece 10 and the other group 46'' serving to emit light rays to the lower fabric piece 12, as, shown in FIG. 4. The sets of light-receiving optical fibers 48 and 50 serve to receive light rays reflected by the upper and lower fabric pieces 10 and 12, respectively. The light-emitting unit 52 has a light source 58 for applying a ray of white light to the ends of the light-emitting optical fibers 46 through a lens 56. The light-detecting unit 54 has color sensors 60 and 62 for detecting intensities of respective light rays from the ends of the light-receiving optical fibers 48 and 50.

Figure 6:
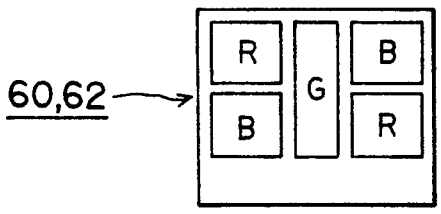
FIG. 6 is a view of color filters of color sensors.

As shown in FIG. 6, each of the color sensors 60 and 62 includes a plurality of photodiodes whose entrance sides are covered with respective color filters that transmit red (R), blue (B), and green (G) so that the photodiodes may detect, with high sensitivity, intensities of the three primary color lights separated by the color filters. The color filters are arranged such that filters of the same hue are spaced therefrom to widen the light-detecting area. Therefore, even if the light rays from the ends of the light-receiving optical fibers 48 and 50 are displaced as they fall on the color sensors 60 and 62, the lights of respective hues can be detected efficiently.

The rays of white light produced by the light source 58 are transmitted through the lens 56 and the light-emitting optical fibers 46, and then reflected by surfaces of the prisms 38 and 40 in the detector 36 toward the upper and lower fabric pieces 10 and 12. Rays of light which are reflected by the upper and lower fabric pieces 10 and 12 are reflected by surfaces of the prisms 38 and 40 and travel back through the light-receiving optical fibers 48 and 50 to the color sensors 60 and 62, which detect intensities of the rays of light that have been color-separated into three primaries. Color signals indicating the intensities of thus separated three primary color light rays are derived from the color sensors 60 and 62 to be supplied to an electronic controller 100 housed in the control casing 44.

A control panel 64 as shown in FIG. 2 has a liquid crystal display unit 66 for displaying characters, numerals, etc., a pattern match control key 80 for controlling a pattern match operation to be started and to be stopped as will be described later, a pattern pitch key 74 for changing pattern pitches, and incremental and decremental keys 76 and 78 for respectively incrementing and decrementing the number displayed on the liquid crystal display unit 66 when a pattern pitch is to be changed.

The motor 2, the stepper motor 15, the rotation synchronization sensor 20, the potentiometer 14, the needle position sensors 16 and 18, the signal generator 24, the color sensors 60 and 62, and the control panel 64 are electrically connected to the electronic controller 100. The electronic controller 100 includes a known CPU 102, a ROM 104 which stores a control program and data, a RAM 106, drivers 108 and 110 as input/output circuits, and an A/D converter 112 for converting analog signals into digital signals. The CPU 102, the ROM 104, the RAM 106, the drivers 108 and 110, and the A/D converter 112 are connected to each other by a common bus 114. The CPU 102 receives signals from the rotation synchronization sensor 20, the potentiometer 14, the needle position sensors 16 and 18, the signal generator 24, the color sensors 60 and 62, and the control panel 64, and outputs drive signals through the drivers 108 and 110 to the motor 2 and the stepper motor 15 based on the signals and the data in the ROM 104 and the RAM 106 according to the control program in the ROM 104.

A pattern matching operation of the pattern matching system 200 of the present invention incorporated in the sewing machine 300 will be described hereinafter. The pattern matching operation is conducted when the electronic controller 100 executes a pattern matching routine shown in FIGS. 7(*a*) and 7(*b*) and an interrupt routine shown in FIG. 8.

Figure 7A:
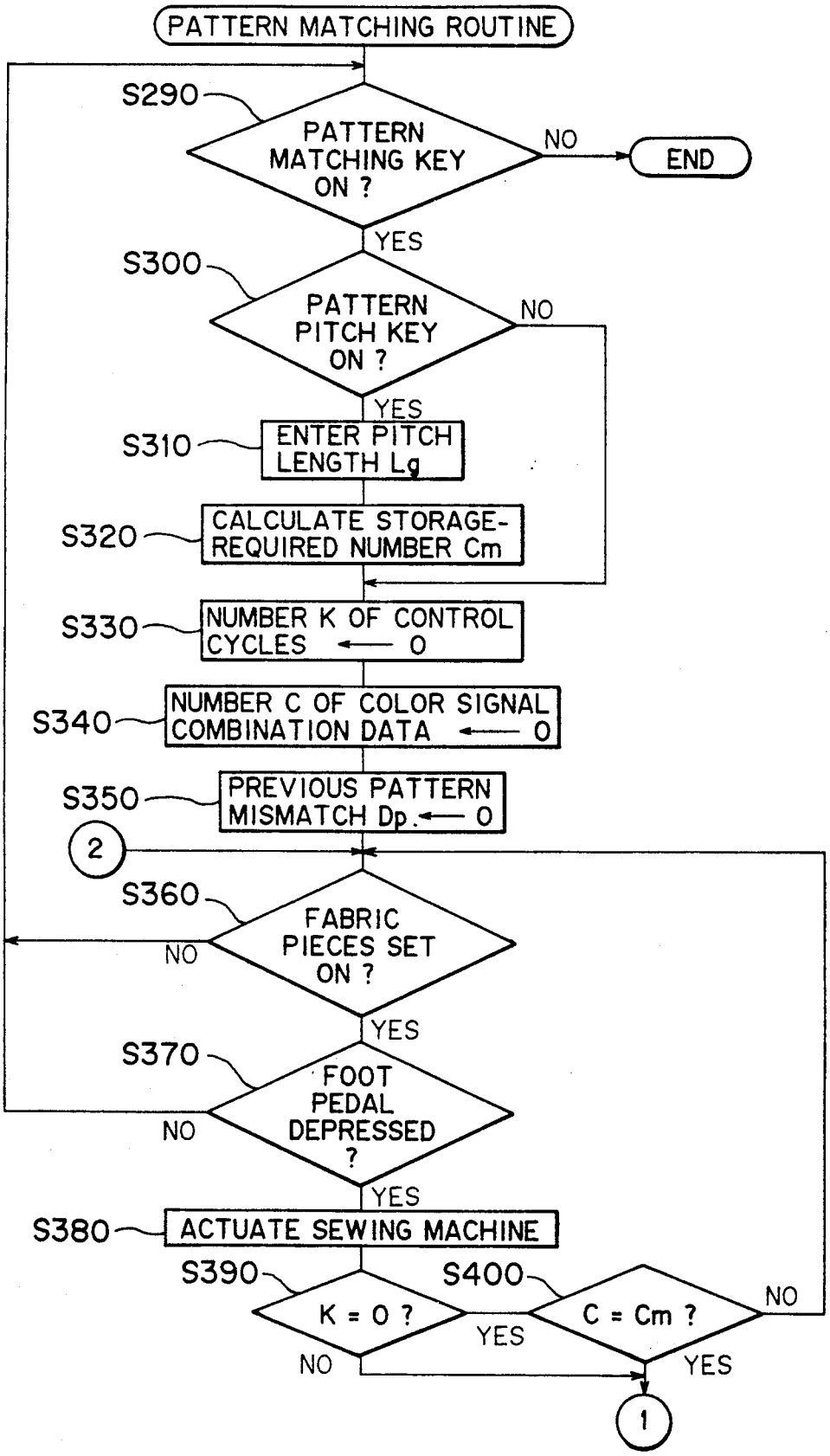
FIGS. 7(*a*) and 7(*b*) are flowcharts of a pattern matching routine to be executed by an electronic controller in the pattern matching system.
Figure 7B:
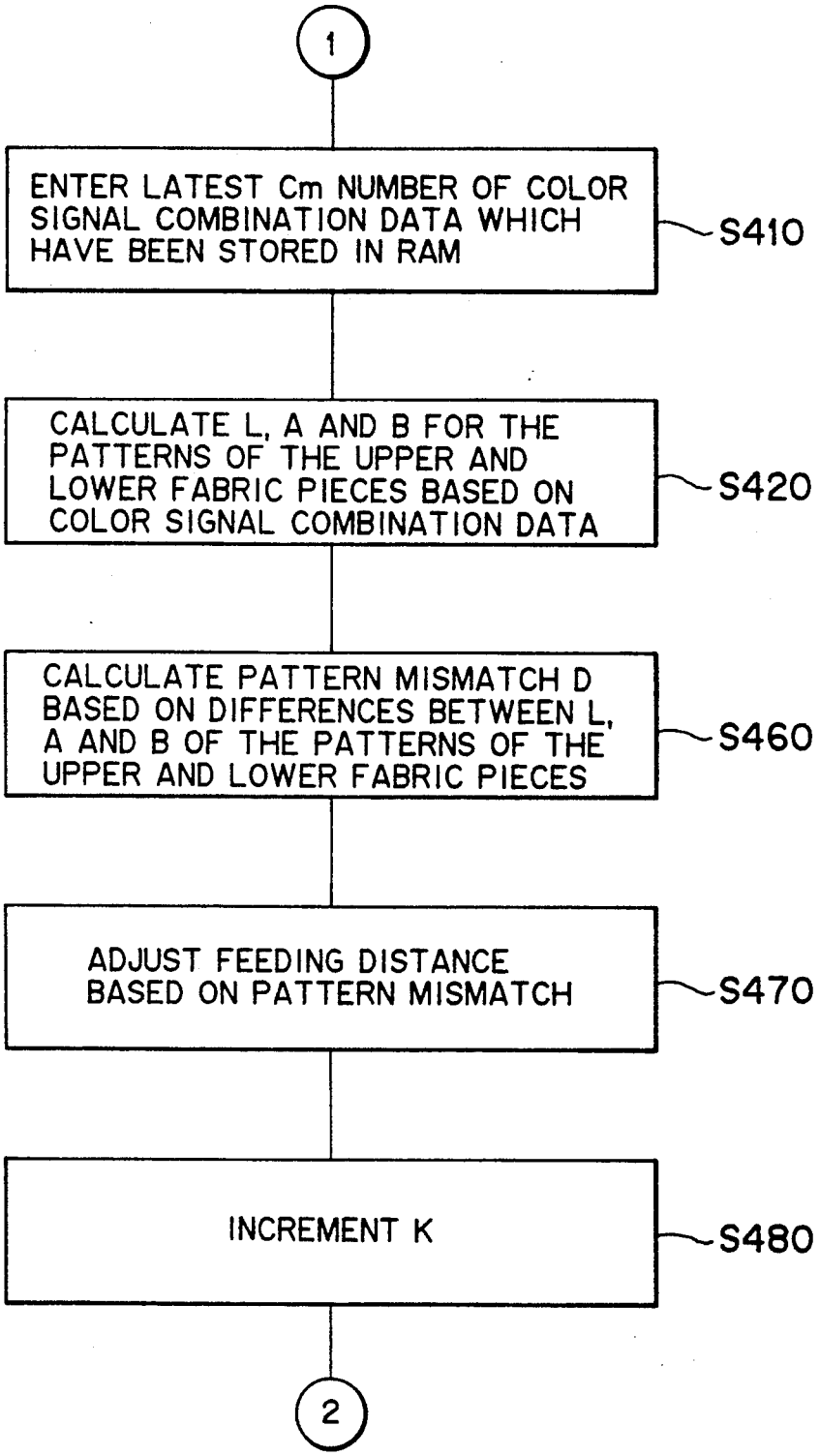
Figure 8:
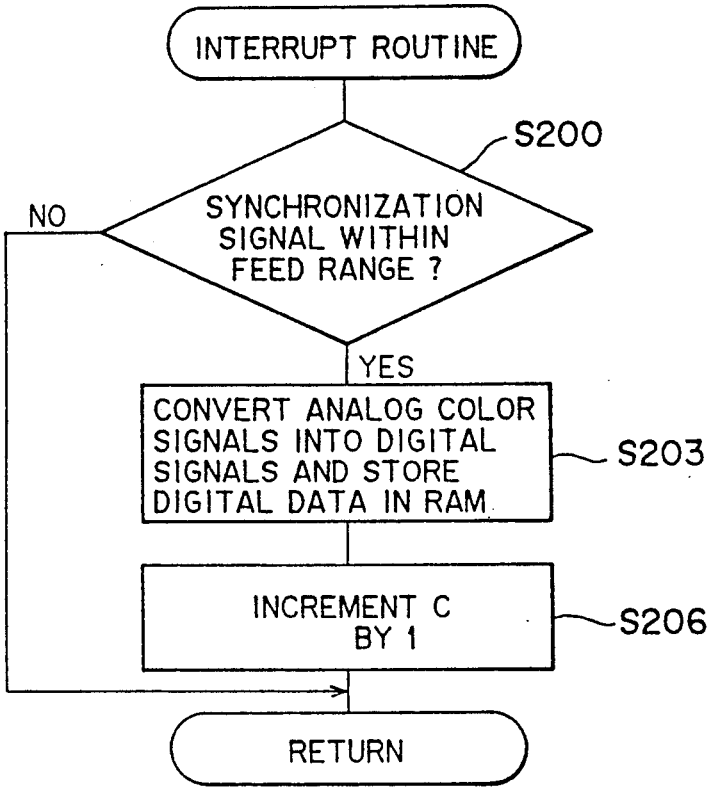
FIG. 8 is a flowchart of an interrupt routine.

The pattern matching routine shown in FIGS. 7(*a*) and 7(*b*) is conducted for calculating a mismatch amount D of patterns of the upper and lower fabric pieces 10 and 12 and adjusting a feeding amount of the upper feed dog 6 to thereby align the patterns on the two fabric pieces with each other while sewing the two fabric pieces. The interrupt routine shown in FIG. 8 is conducted for storing in the RAM 106 total color data for the patterns on the fabric pieces which are to be used in the pattern matching routine for calculating the mismatch amount D.

The interrupt routine shown in FIG. 8 will be first described hereinafter.

The interrupt routine is executed when the pattern matching routine conducts a sewing operation, as will be described later. More specifically, the interrupt routine starts to be executed by a negative-going edge of a synchronization signal which is produced by the rotation synchronization sensor 20 during the sewing operation in synchronism with operation of the sewing needle 1, the lower feed dog 4, etc. The interrupt routine is repeatedly carried out in response to the pulse signal from the rotation synchronization sensor 20.

In the interrupt routine, a step S200 first judges whether the synchronization signal from the rotation synchronization sensor 20 falls within a feed range in which the upper and lower fabric pieces 10 and 12 are being fed, i.e., whether the synchronization signal is being produced while the upper and lower fabric pieces 10 and 12 are being fed by the upper and lower feed dogs 6 and 4 after the sewing needle 1 has been elevated. If the synchronization signal is not within the feed range, then control leaves the interrupt routine and returns to a main routine, i.e., the pattern matching routine shown in FIGS. 7(*a*) and 7(*b*). If the synchronization signal is within the feed range, then six color signals (red, blue and green signals for the upper fabric piece 10 and red, blue and green signals for the lower fabric piece 12) which are detected by the color sensors 60 and 62 and converted into digital signals by the A/D converter 112 are stored as a combination data of color signals in the RAM 106 in a step S203. Then, the number C of the color signal combination data stored in the RAM 106 is incremented by 1 in a step S206, after which control returns to the main routine. As a result, the RAM 106 stores only those color signal combination data which are detected while the upper and lower fabric pieces 10 and 12 are being fed by the upper and lower feed dogs 6 and 4 in the direction indicated by the arrow A.

As will be described later, steps 360 through 400 of the main routine shown in FIG. 7(*a*) are conducted repeatedly to repeatedly conduct the interrupt routine until when the number of the color signal combination data stored in the RAM 106 reaches a storage-required number Cm. The number Cm is determined in a step S320 in the main routine, as will be described later. The Cm number of color signal combination data thus stored in the RAM 106 will provide color informations for an entire range of a single pitch of the patterns on each of the fabric pieces. Since each of the fabric pieces has such a design that a plurality of identical patterns are arranged by a predetermined pitch, thus stored Cm number of color signal combination data provide total color informations for the patterns of the fabric pieces.

The pattern matching routine will be described below with respect to FIGS. 7(*a*) and 7(*b*). The pattern matching routine is started to be executed at the time when the operator turns on or pushes the pattern match control key 80 on the control panel 64. The pattern matching routine is stopped when the operator turns off or pushes again the control key 80. In other words, the pattern matching routine is conducted when the operator desires to match the patterns on the fabric pieces with each other.

The operator of the sewing machine can turn on the pattern pitch key 74 and can operate the incremental and decremental keys 76 and 78 for changing a value of a previously set pitch length Lg to newly set a desired pitch length (which is normally slightly longer than an actual pattern pitch).

When the operator turns on the pattern match control key 80, the pattern matching routine starts, and a step S290 reads the status of the pattern match control key 80 to judge whether the key 80 is turned on or off. If the key 80 is turned off, the pattern matching routine is stopped to be executed. If the key 80 is turned on, the step proceeds to a step S300. The step S300 reads the status of the pattern pitch key 74 to judge whether the pattern pitch key 74 is turned on or not. If the pattern pitch key 74 is not turned on, then the previously set length Lg is not varied, and control jumps to a step S330. If the pattern pitch key 74 is turned on, then a step S310 reads the pitch length Lg newly selected by the operator. Then, a step S320 calculates the number Cm of the color signal combination data required to be accumulated in the interrupt routine.

The storage-required number Cm for the color signal data is calculated as described hereinafter.

As described already, the Cm number of color signal combination data are defined to provide total color informations for a single pitch of the patterns on each of the fabric pieces. The number Cm is therefore defined as the number of the color signal combination data to be sampled from the entire range of the single pattern pitch having the length Lg of the each fabric piece. As will be described later, during a sewing operation, the fabric pieces 10 and 12 are to be fed by the upper and lower dogs 6 and 4 by the same feed distance in the feed range. The color signal combination data are to be stored during the feed range in response to the synchronization signals produced by the sensor 20. Therefore, the number Cm is determined by the pattern pitch length Lg, the feed distance F of the fabric pieces attained by a single cyclic operation of the feed dogs in a single feed range and the number P of synchronization signals produced during the single feed range according to the following equation: $Cm = P \times Lg / F$.

For example, if the pitch length Lg is set to 30 [mm] and the distance by which the fabric pieces 10 and 12 are to be fed in the single feed range is set to 2 [mm], and the number of synchronization signals in the feed range is 10 [pulses], then the number Cm is calculated by the equation: 10 [pulses]×30 [mm]/ 2 [mm], and hence becomes 150.

After when the Cm is calculated, the number K of control cycles which will be describe later, the number C of color signal combination data and a previously calculated pattern misalignment or mismatch Dp, which are stored in the RAM 106, are all cleared in respective steps S330, S340 and S350. Thereafter, the CPU 102 judges whether or not the upper and lower fabric pieces 10 and 12 are set on the sewing machine in a step S360. If the upper and lower fabric pieces 10 and 12 are set, then the CPU 102 further judges whether the front end of the foot pedal 22 is depressed and the signal generator 24 generates a start signal in a step S370. If the front end of the foot pedal 22 is depressed and the start signal is generated, then the CPU 102 energizes the motor 2 in a step S380 to actuate the sewing machine to conduct its operation. If it is determined in the step S360 that the upper and lower fabric pieces 10 and 12 are not set on the sewing machine, or if it is determined in the step S370 that the front end of the foot pedal 22 is not depressed, then control goes back to the step S290. Thus, the steps S290 through S350 are repeatedly conducted until when the fabric pieces are set on the sewing machine and the pedal 22 is depressed.

When the motor 2 is energized in the step S380 with a thread being inserted through the sewing needle 1, the upper and lower fabric pieces 10 and 12 are started to be sewn to each other in overlapping relationship. After when the sewing operation is thus started in the step S380, the sewing operation is continued to be performed, until when the foot pedal 22 is released from the depression by the foot of the operator and the signal generator 24 generates the stop signal to control the motor 2 to be stopped. The status of the foot pedal is judged in the step S370. The motor 2 is thus continued to be rotated in any steps of the pattern matching routine until when the stop signal stops the motor. As described already, the interrupt routine shown in FIG. 8 is executed in synchronism with the rotation of the motor 2 to successively store new color signal combination data in the RAM 106. The interrupt routine is repeatedly conducted during when the motor 2 is rotated. The interrupt routine is therefore conducted in any steps of the pattern matching routine during when the motor 2 is driven to conduct its sewing operation.

If the number K of control cycles (described later on) is 0 in a step S390 and the number C of the color signal data stored in the RAM 106 has not reached the storage-required number Cm in a step S400, then the steps S360 through S400 are repeated, so that the upper and lower fabric pieces 10 and 12 are sewn and the color signal combination data are further accumulated in the interrupt routine.

On the other hand, if the number K of control cycles is 0 in the step S390, but the number Cm is reached in the step S400, it is judged that total color informations for the patterns of the fabric pieces 10 and 12 are obtained and that it is ready for calculating the mismatch amount D of the patterns of the fabric pieces. Then, steps S410 through S480 shown in FIG. 7(*b*) for performing a pattern matching process is started to be executed.

If the number K of the control cycles is not 0 in the step S390, it is judged that the Cm number of color signal combination data are already stored in the RAM 106 during the previously conducted control cycle. Therefore, the pattern matching process is also started to be executed. In the pattern matching process of this control cycle, the latest Cm number of the color signal combination data which have been stored in the RAM 106 are read out therefrom, so that the data which have been stored in this control cycle and the data which have been stored in the previous control cycle are both read out to be used for a mismatch amount calcuration as will be described later.

In the pattern matching process shown in FIG. 7(*b*), after when the steps S410 and S420 are conducted as will be described later, a pattern mismatch D is calculated from the accumulated Cm number of color signal combination data in a step S460 (described later on), and the stepper motor 15 is energized to adjust the distance by which the upper feed dog 6 feeds the upper fabric piece 10 in a direction to reduce the absolute value of the pattern mismatch D in a step S470. For example, if the upper fabric piece 10 is fed ahead of the lower fabric piece 12, then the distance by which the upper fabric piece 10 is fed by the upper feed dog 6 is reduced until the patterns on the upper and lower fabric pieces 10 and 12 match or are aligned with each other.

The manner how the pattern mismatch amount D is calculated in the steps S410 through S460 will be described hereinafter.

The latest Cm number of the color signal combination data which have been stored in the RAM 106 are read out in a step S410 therefrom. A lightness component L and components A and B indicating hue and saturation for each of the patterns of the fabric pieces 10 and 12 are calculated in a step S420, according to the following equations, based on the R, G and B color signal data which are detected by the color sensors 60 and 62 and which correspond to intensities of the R, G and B primary components of the light reflected from the fabric pieces:

$$X = (0.62R + 0.17G + 0.18B)/0.98$$
$$Y = (0.31R + 0.59G + 0.11B)/1.18$$
$$Z = 0.066G + 1.02B$$
$$L = 116Y^{1/3} - 16$$
$$A = 500(X^{1/3} - Y^{1/3})$$
$$B = 200(Y^{1/3} - Z^{1/3}).$$

where R, G and B represent the R, G and B color signal data.

Figure 9:
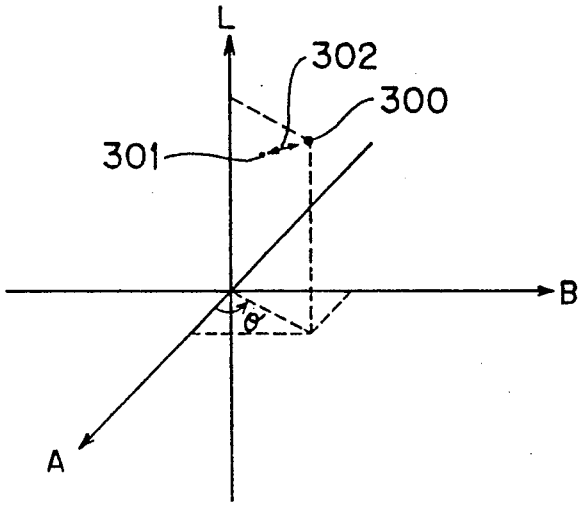
FIG. 9 is a diagram illustrative of color qualities which are perceivable by human eyes and differences between colors.
Figures 10, 10A, 10B, 10C, 10D, 10E, 10F, 10G, 10H, 10I, 10J, 10K, 10L, 10M:
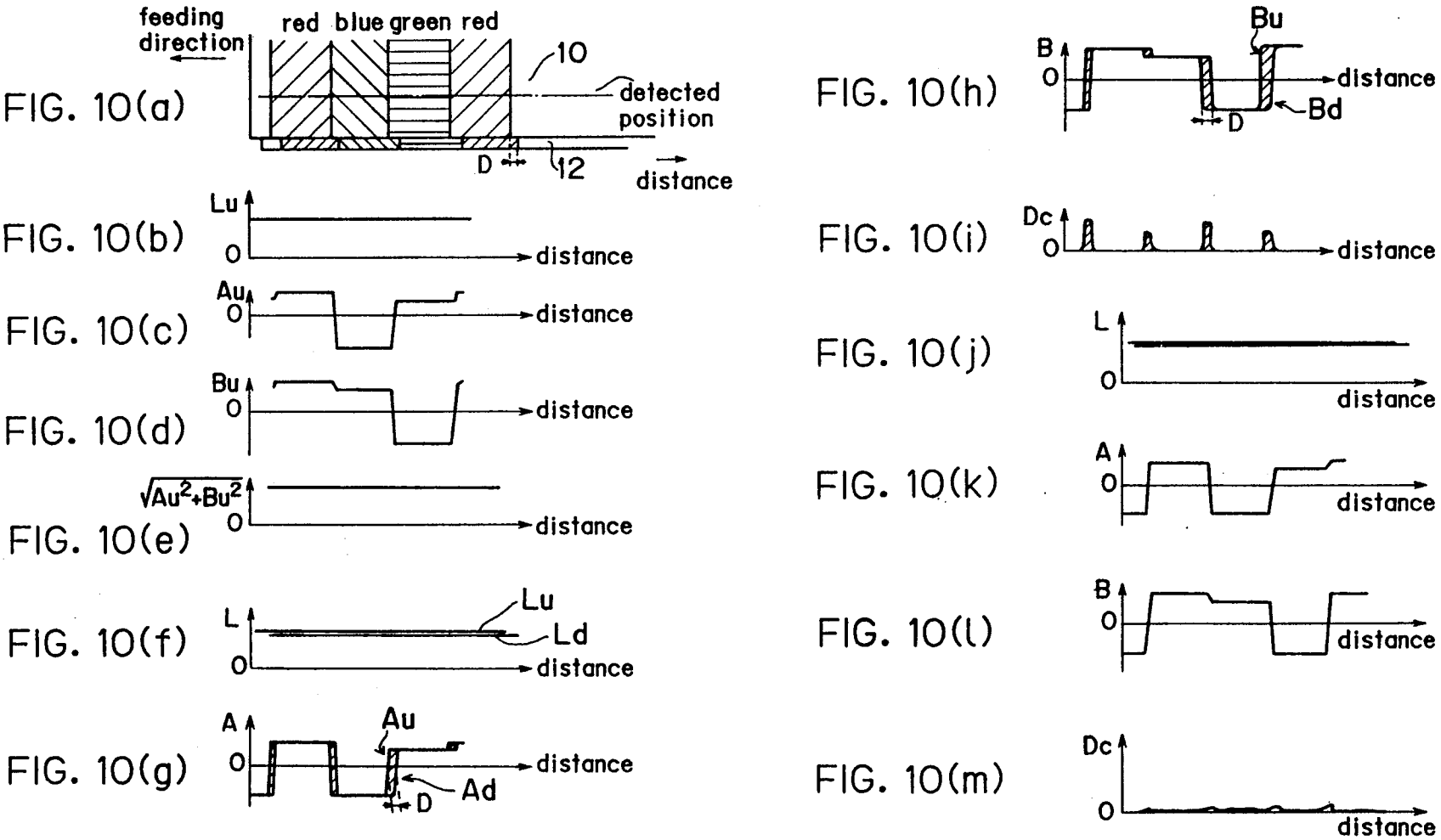
FIG. 10(*a*) is a diagram showing patterns on upper and lower fabric pieces.

As shown in FIG. 9, the color qualities of a color 300 in a region on the upper fabric piece 10 which are detected by the color sensor 60 and can be perceived by human eyes include lightness L indicating the brightness of the pattern on the fabric piece, saturation S $(=(A^2+B^2)^{\frac{1}{2}})$ indicating the color depth of the pattern, and hue $\theta(=\tan^{-1}(B/A))$ indicating the type of the color. The color qualities of lightness, saturation, and hue which are calculated according to the above equations can be perceived by human eyes as independent qualities. The difference between the color 300 of the upper fabric piece 10 and a color 301 of the lower fabric piece 12 is expressed as a distance 302 in a three-dimensional space defined by three orthogonal axes indicated by L, A and B. FIGS. 10(*a*) through 10(*m*) show a process conducted in the step S460 for calculating the pattern mismatch D based on the color qualities L, A and B obtained as described above, in the case where the upper and lower fabric pieces 10 and 12 have patterns of the same lightness and saturation.

In FIG. 10(*a*), the upper fabric piece 10 is fed ahead of the lower fabric piece 12. The components L, A and B of the upper fabric piece 10 have waveforms Lu, Au, Bu, respectively, which are expressed as shown in FIGS. 10(*b*), 10(*c*), and 10(*d*), respectively, according to the above calculations. The saturation of the color of the upper fabric piece 10 is of a constant value in the area in which the pattern is detected, as shown in FIG. 10(*e*). Likewise, waveforms Ld, Ad and Bd of the components L, A and B of the lower fabric piece 12 are generated according to the above calculations.

The pattern mismatch D is calculated on the basis of the waveforms of the components L, A and B of the upper and lower fabric pieces 10 and 12 as follows:

Differences between the components of the upper and lower fabric pieces 10 and 12 are calculated by:

$$\Delta L = Lu - Ld,\ \Delta A = Au - Ad,$$

$$\Delta B = Bu - Bd.$$

The magnitudes of the differences ΔL, ΔA, ΔB are shown hatched in FIGS. 10(*f*), 10(*g*) and 10(*h*) with respect to the respective Cm number of data.

Then, the difference in color between the upper and lower fabric pieces 10 and 12 is calculated as a distance in the space defined by the orthogonal axes L, A and B as follows:

$$Dc = (p\Delta L^2 + q\Delta A^2 + r\Delta B^2)^{\frac{1}{2}}$$

where p, q and r are positive corrective coefficients that have experimentally established. The values p, q and r depend on various facts, e.g., characteristics of the optical system such as sensitivity of the color filters and the fact which one of the lightness and the hue of the patterns can be perceived more impressively by human eyes. The color difference Dc is calculated with respect to each of the Cm number of data determined in the step S420 as shown in FIG. 10(*i*), and a sum SDc of the calculated color differences Dc for all the Cm number of data is determined.

Then, the sum SDc is repeatedly calculated while relatively shifting the waveforms Lu, Au and Bu of the upper fabric piece 10 and the waveforms Ld, Ad and Bd of the lower fabric piece 12. When the sum SDc is minimum, the mismatch D and its direction are calculated from the distance by which the upper and lower fabric pieces 10 and 12 are relatively shifted. For example, as shown in FIGS. 10(*j*) through 10(*m*), when the upper fabric piece 10 is shifted to the right by a distance D with respect to the lower fabric piece 12, the waveforms Lu, Au and Bu and the waveforms Ld, Ad, Bd are superimposed on each other, minimizing the sum SDc. At this time, the upper fabric piece 10 is determined as being fed ahead of the lower fabric piece 12 by the distance or mismatch D.

Then, the distance by which the upper fabric piece 10 is fed is adjusted so that the mismatch D will be reduced, in a step S470. In the step S470, the angular displacement of the stepper motor 15 is adjusted on the basis of a PID (proportional/integral/derivative) control process effected on the mismatch D. More specifically, a distance composed of a proportional component proportional to the mismatch, an integral component proportional to an integral of the mismatch, and a derivative component proportional to a derivative of the mismatch is calculated, and the stepper motor 15 is energized for an angular displacement corresponding to the calculated distance, thereby adjusting the distance by which the upper fabric piece 10 is fed with respect to the distance by which the lower fabric piece 12 is fed.

Thus, the present control cycle is finished, and the number K of control cycles is incremented by 1 in a step S480. Control then returns to the step S360, repeating the above-described steps to conduct a next control cycle. At this next control cycle, however, the steps S360 through S390 are conducted once. That is, the pattern matching process of the steps S410 through S480 are started to be executed immediately after the step S390. Then, in the step S410, the latest Cm number of the color signal combination data which have been stored in the RAM 106 are read out therefrom. As a result, the latest stored Cm number of the data out of those which have been stored in this control cycle during the steps 360 through 390 and those which have been stored in the previously conducted control cycle are read out from the RAM. Thus read out Cm number of the color signal combination data are subjected to the mismatch amount calculation operation at this control cycle.

The control cycle of the pattern matching operation, i.e., the steps S360 through S480 is repeatedly conducted with increasing the control cycle number K, until when the fabric pieces are taken away from the sewing machine and the fact is judged in the step S360 or until when the pedal 22 is released from the depression by the operator's foot and the fact is judged in the step S370. When the fabric pieces are taken away or the pedal 22 is released from the depression, the pattern matching routine backs to its first stage. That is, the pattern matching routine backs to the step S290 from the step S360 or S370. Then, the steps S290 through S350 are continuously conducted until when the fabric pieces are set again and the food pedal is depressed again. On the other hand, when the operator turns off or pushes again the pattern match control key 80 on the control panel 64, the fact is judged in the step S290 and the operation is stopped.

Inasmuch as any pattern mismatch or misalignment between the upper and lower fabric pieces 10 and 12 is calculated on the basis of information with respect to the quality of color including color type or color hue, the mismatch can accurately be detected even if the upper and lower fabric pieces 10 and 12 have the same lightness and saturation. Accordingly, the upper and lower fabric pieces 10 and 12 can be matched or aligned with each other, so that they can be sewn to each other with a desired pattern match.

As described above, any mismatch or misalignment between the upper and lower fabric pieces is calculated on the basis of items of visual information such as lightness, saturation, and hue, which can be perceived by the human sense of vision. The operator is not required to select any optical information in detecting any mismatch between patterns, but any mismatch between patterns can be detected without manual intervening adjustment.

While the difference in color between the upper and lower fabric pieces 10 and 12 is calculated as a distance Dc in a space defined by the components L, A and B in the above embodiment, the square of the distance Dc or the sum of the absolute values of the differences $\Delta L$, $\Delta A$ and $\Delta B$ may be employed as the difference in color. With the values of the corrective coefficients p, q and r being suitably selected, any pattern mismatch may be detected mainly based on lightness or hue. The components A and B may be broken up into saturation S and hue $\Theta$, and any pattern mismatch mainly based on saturation S or hue $\Theta$ may be detected according to the difference in saturation or hue between the upper and lower fabric pieces 10 and 12.

The conversion of the color signal data into the components L, A and B may be carried out in the step S203 of the interrupt routine, rather than in the step S420. Noise produced when the patterns are detected may be lowered by smoothing the color signal data before the step S420.

The color qualities perceivable by human eyes are represented using the coordinates indicated by L, A and B in the above embodiment. However, the color difference may be calculated using similar coordinates.

The conversion from the color signals detected by the color sensors into the color qualities may be effected by an electric hardware system or optical arrangement, rather than the illustrated software approach.

Although a certain preferred embodiment of the present invention has been shown and described in detail, it should be understood that various changes and modifications may be made therein without departing from the scope of the appended claims.

For example, the pattern matching system of the present invention may be applied to an ultrasonic machining apparatus for applying ultrasonic vibrations to sheet-like members with identical patterns to weld them together.

I claim:

1. A pattern matching system for positioning with respect to each other a plurality of pattern-holding members having identical patterns thereon in such a manner that the patterns on the pattern-holding members are matched with each other, said pattern matching system comprising:

color quality detecting means for optically detecting a color of the pattern on each of the pattern-holding members to generate information indicative of hue of the color of the pattern;

pattern mismatch calculating means for calculating a mismatch amount between the patterns on the pattern-holding members, based on the information indicative of hue of the color of the pattern of each of the pattern-holding members; and feeding means for feeding the pattern-holding members relative to each other, based on the calculated mismatch amount, to thereby position the pattern-holding members with the patterns being matched.

2. The pattern matching system as claimed in claim 1, wherein said color quality detecting means includes:

color component detecting means for detecting intensities of a plurality of color components of different hues of the color of the pattern on each of the pattern-holding members; and converting means for converting the detected intensities of the plural color components of different hues into color hue data representative of hue of the color of the pattern of each of the pattern-holding members, to thereby generate the information indicative of hue of the color of the pattern.

3. A pattern matching system as claimed in claim 2, wherein the color component detecting means includes:

light emitting means for emitting light to the pattern on each of the pattern-holding members;

a set of color filters for separating the light reflected from the patterns into light of a plurality of color components of different hues; and intensity detecting means for detecting intensities of the separated light of color components of different hues, to thereby obtain intensities of the plurality of color components of different hues of the color of the pattern on each of the pattern-holding members.

4. The pattern matching system as claimed in claim 3, wherein the color component detecting means includes:

white light emitting means for emitting white light to the pattern on each of the pattern-holding members;

a set of color filters for separating the light reflected from the patterns into light of three primary color components of red, green and blue; and intensity detecting means for detecting intensities of the separated light of three primary color components, to thereby obtain intensities of the three primary color components of the color of the pattern on each of the pattern-holding members.

5. The pattern matching system as claimed in claim 4, wherein said pattern mismatch calculating means includes subtracting means for calculating a difference between the color hue data of thee colors of the patterns on the pattern-holding members to thereby calculate the pattern mismatch amount.

6. The pattern matching system as claimed in claim 5, further comprising processing means for joining the pattern-holding members in such a condition that the patterns on the pattern-holding members are matched with each other.

7. The pattern matching system according to claim 6, wherein the pattern-holding members include first and second sheets having identical patterns thereon and wherein said processing means includes sewing means for sewing the first and second sheets.

8. The pattern matching system as claimed in claim 2, wherein the converting means further converts the detected intensities of the plural color components of different hues into color lightness data representative of lightness of the color of the pattern of each of the pattern-holding members, to thereby generate information indicative of lightness of the color of the pattern, and wherein said pattern mismatch calculating means calculates the mismatch amount, based on both the information indicative of hue and lightness of the color of the pattern of each of the pattern-holding members.

9. The pattern matching system as claimed in claim 8, wherein the converting means further converts the detected intensities of the plural color components of different hues into color saturation data representative of saturation of the color of the pattern of each of the pattern-holding members, to thereby generate information indicative of saturation of the color of the pattern, and wherein said pattern mismatch calculating means calculates the mismatch amount, based on the information indicative of hue, lightness and saturation of the color of the pattern of each of the pattern-holding members.

10. The pattern matching system as claimed in claim 9, wherein the pattern-holding members includes first and second sheets having identical patterns thereon, and wherein said pattern mismatch calculating means includes subtracting means for calculating a hue difference between the color hue data obtained for a color on the first sheet and the color hue data obtained for a color on the second sheet, a lightness difference between the color lightness data obtained for the color on the first sheet and the color lightness data obtained for the color on the second sheet, and a saturation difference between the color saturation data obtained for the color on the first sheet and the color saturation data obtained for the color on the second sheet, to thereby calculate the pattern mismatch amount.

11. The pattern matching system as claimed in claim 10, wherein said pattern mismatch calculating means further includes:

squaring means for calculating square values of the hue difference, the lightness difference and the saturation difference, respectively;

multiplying means for multiplying the square values of the hue difference, the lightness difference and the saturation difference by first through third coefficients, respectively, values of the first through third coefficients being determined dependent on human visual sense; and totaling means for calculating a sum of the square values of the hue difference, the lightness difference and the saturation difference multiplied by the first through third coefficients, to obtain color difference data representative of color difference state between the colors of the patterns on the first and second sheets, to thereby calculate the pattern mismatch amount.

12. The pattern matching system as claimed in claim 9, wherein said color quality detecting means determines a color quality of the color of the pattern on each pattern-holding member, as a point in a three-dimensional color space defined by three orthogonal axes each for indicating the color hue data, the color lightness data and the color saturation data, and wherein said pattern mismatch calculating means calculates a relationship between points in the three-dimensional color space which represent the color qualities of the colors of the patterns on the pattern-holding members, to thereby obtain the mismatch amount between the patterns of the pattern-holding members.

13. The pattern matching system as claimed in claim 1, wherein the pattern-holding members include first and second sheets having identical patterns thereon, and wherein said color quality detecting means includes:

photo-sensing means for optically sensing the color of the pattern on each of the first and second sheets at a plurality of points thereof and for generating intensity data of a plurality of color components of different hues for the color on each of the points on each of the first and second sheets; and converting means for converting the detected intensity data of the plural color components of different hues into color hue data representative of hue of the color of the pattern of each of the first and second sheets at each of the plural points, to thereby generate the information indicative of hue of the color of the pattern at each of the plural points on each of the first and second sheets.

14. The pattern matching system as claimed in claim 13, wherein said photo-sensing means includes:

light emitting means for emitting light to the pattern on each of the first and second sheets at each of the plural points;

a set of color filters for separating the light reflected from the pattern into light of the plurality of color components of different hues; and intensity detecting means for detecting intensities of the separated light of different hue color components, to thereby generate intensity data of the plurality of color components of different hues for the color of the pattern at each point on each of the first and second sheets.

15. The pattern matching system as claimed in claim 14, wherein said photo-sensing means includes:

white light emitting means for emitting white light to the pattern on each of the first and second sheets at each of the plural points;

a set of color filters for separating the light reflected from the pattern into light of three primary color components of red, green and blue; and intensity detecting means for detecting intensities of the separated light of the three primary color components, to thereby generate intensity data of the three primary color components for the color of the pattern at each of the plural points on each of the first and second sheets.

16. The pattern matching system as claimed in claim 14, wherein the converting means further converts the detected intensity data of the plural color components of different hues into color lightness data representative of lightness of the color of the pattern at each of the plural points on each of the first and second sheets, to thereby generate information indicative of lightness of the color of the pattern at each of the plural points on each of the first and second sheets, and wherein said pattern mismatch calculating means calculates the mismatch amount, based on both the information indicative of hue and lightness of the color of the pattern at each of the plural points on each of the first and second sheets.

17. The pattern matching system as claimed in claim 16, wherein the converting means further converts the detected intensity data of the plural color components of different hues into color saturation data representative of saturation of the color of the pattern at each of the plural points on each of the first and second sheets, to thereby generate information indicative of saturation of the color of the pattern at each of the plural points on each of the first and second sheets, and wherein said pattern mismatch calculating means calculates the mismatch amount, based on the information indicative of hue, lightness and saturation of the color of the pattern at each of the plural points on each of the first and second sheets.

18. The pattern matching system as claimed in claim 17, wherein said pattern mismatch calculating means includes subtracting means for calculating a hue difference between the color hue data obtained for a color of a point on the first sheet and the color hue data obtained for a color of a point on the second sheet, a lightness difference between the color lightness data obtained for the color on the point of the first sheet and the color lightness data obtained for the color of the point on the second sheet, and a saturation difference between the color saturation data obtained for the color on the point of the first sheet and the color saturation data obtained for the color of the point on the second sheet, to thereby calculate the pattern mismatch amount.

19. The pattern matching system as claimed in claim 18, wherein said pattern mismatch calculating means further includes:

squaring means for calculating square values of the hue difference, the lightness difference and the saturation difference, respectively;

multiplying means for multiplying the square values of the hue difference, the lightness difference and the saturation difference by first through third coefficients, respectively, values of the first through third coefficients being determined dependent on human visual sense; and totaling means for calculating a sum of the square values of the hue difference, the lightness difference and the saturation difference multiplied by the first through third coefficients, to obtain color difference data representative of color difference state between the color of the point on the first sheet and the color of the point on the second sheet, to thereby calculate the pattern mismatch amount.

20. The pattern matching system as claimed in claim 19, wherein said pattern mismatch calculating means further includes totaling means for calculating a sum of the color difference data for all the plural points on the pattern on the first and second sheets, to thereby calculate the pattern mismatch amount.

21. The pattern matching system as claimed in claim 20, further comprising processing means for joining the first and second sheets in such a condition that the patterns on the first and second sheets are matched with each other.

22. The pattern matching system according to claim 21, wherein said processing means includes a sewing means for sewing the first and second sheets.

23. A pattern matching system for positioning with respect to one another a plurality of pattern-holding members having identical patterns thereon in such a manner that the patterns on the pattern-holding members are matched with one another, said pattern matching system comprising:

color quality detecting means for receiving light from the patterns on the pattern-holding members to thereby obtain information indicative of qualities of colors of the patterns;

pattern mismatch calculating means for calculating a mismatch amount between the patterns on the pattern-holding members, based on the information indicative of the qualities of colors of the patterns; and feeding means for feeding the pattern-holding members relative to each other, based on the calculated mismatch amount, to thereby position the pattern-holding members with the patterns being matched;

wherein said color quality information detecting means includes: light intensity detecting means for detecting intensities of the light of different hues from the patterns on the pattern-holding members; and means for converting the detected intensities of light of different hues into the information indicative of qualities of colors of the patterns;

wherein said light intensity detecting means includes: means for emitting light to the patterns on the pattern-holding members; a set of color filters for separating the light reflected from the patterns into light of colors of different hues; and means for detecting intensities of the separated light of different hue colors; and wherein said converting means calculates color quality data determining lightness, saturation and hue of the colors of the patterns on the pattern-holding members, based on the detected intensities of the light of the different hues.

24. A pattern matching system for positioning with respect to one another a plurality of pattern-holding members having identical patterns thereon in such a manner that the patterns on the pattern-holding members are matched with one another, said pattern matching system comprising:

color quality detecting means for receiving light from the patterns on the pattern-holding members to thereby obtain information indicative of qualities of colors of the patterns;

pattern mismatch calculating means for calculating a mismatch amount between the patterns on the pattern-holding members, based on the information indicative of the qualities of colors of the patterns; and feeding means for feeding the pattern-holding members relative to each other, based on the calculated mismatch amount, to thereby position the pattern-holding members with the patterns being matched;

wherein said color quality information detecting means includes; light intensity detecting means for detecting intensities of the light of different hues from the patterns on the pattern-holding members; and means for converting the detected intensities of light of different hues into the information indicative of qualities of colors of the patterns;

wherein said light intensity detecting means includes: means for emitting white light to the patterns on the pattern-holding members; a set of color filters for separating the light reflected from the patterns into light of three primary colors; and means for detecting intensities of the separated light of three primary colors; and wherein said converting means calculates color quality data determining lightness, saturation and hue of the colors of the patterns on the pattern-holding members, based on the detected intensities of the light of the three primary colors.

25. A pattern matching system as claimed in claim 24, wherein said converting means calculates color quality data consisting of three components to thereby determine the qualities of colors of the patterns as points in a three-dimensional color space defined by three orthogonal axes indicated by the three components, and wherein said pattern mismatch calculating means calculates a relationship between the points in the three-dimensional color space, to thereby obtain the mismatch amount between the patterns of the pattern-holding members.

26. The pattern matching system as claimed in claim 25, further comprising processing means for joining the pattern-holding members in such a condition that the patterns on the pattern-holding members are matched.

27. A pattern matching system according to claim 26, wherein said processing means includes a sewing means for sewing the pattern-holding members.

* * * * *